US006561673B2

(12) United States Patent
Frederick

(10) Patent No.: US 6,561,673 B2
(45) Date of Patent: May 13, 2003

(54) DECORATIVE LIGHT STRING WITH STORAGE COMPARTMENT FOR REPLACEMENT COMPONENTS

(75) Inventor: W. Richard Frederick, Mundelein, IL (US)

(73) Assignee: Integrated Power Components, Inc., Mundelein, IL (US)

( * ) Notice: Subject to any disclaimer, the term of this patent is extended or adjusted under 35 U.S.C. 154(b) by 0 days.

(21) Appl. No.: 10/068,452

(22) Filed: Feb. 6, 2002

(65) Prior Publication Data

US 2002/0168892 A1 Nov. 14, 2002

Related U.S. Application Data

(60) Division of application No. 09/854,255, filed on May 14, 2001, and a continuation-in-part of application No. 09/854,255.

(51) Int. Cl.[7] ..... F21V 33/00

(52) U.S. Cl. ..... 362/234; 362/226; 362/253; 439/501; 206/419; 206/702

(58) Field of Search ..... 362/234, 249, 362/226, 227, 253, 154, 95; 439/501, 620, 892, 893; 206/418, 419, 216, 701, 702

(56) References Cited

U.S. PATENT DOCUMENTS

| | | | | |
|---|---|---|---|---|
| 2,034,273 A | | 3/1936 | Smith | |
| 3,214,579 A | | 10/1965 | Pacini | |
| 3,964,040 A | | 6/1976 | Behl | |
| 4,034,259 A | | 7/1977 | Schoch | |
| 4,425,605 A | | 1/1984 | Cheng | |
| 4,684,914 A | | 8/1987 | Wu | |
| 4,714,984 A | * | 12/1987 | Spector | 362/101 |
| 4,727,449 A | | 2/1988 | Fleck | |
| 5,032,961 A | | 7/1991 | Pouyanne et al. | |
| 5,034,846 A | | 7/1991 | Hodge et al. | |
| 5,150,964 A | | 9/1992 | Tsui | |
| 5,290,986 A | | 3/1994 | Colon et al. | |
| 5,317,491 A | | 5/1994 | Lee | |
| 5,365,145 A | | 11/1994 | Fields | |
| 5,676,250 A | | 10/1997 | Walters | |
| 5,975,717 A | | 11/1999 | Rahman | |
| 6,132,257 A | | 10/2000 | Wang et al. | |
| 6,325,665 B1 | * | 12/2001 | Chung | 439/501 |
| 6,394,625 B2 | * | 5/2002 | Demaria | 362/249 |
| 6,478,440 B1 | * | 11/2002 | Jaworski et al. | 362/96 |

* cited by examiner

*Primary Examiner*—Sandra O'Shea
*Assistant Examiner*—Ronald E. DelGizzi
(74) *Attorney, Agent, or Firm*—Jenkens & Gilchrist

(57) ABSTRACT

A string of decorative lights comprises a plurality of elongated electrical conductors having multiple electrical lamps connected thereto at intervals along the lengths of the conductors, a small storage compartment for storing spare components for use in the light string, a movable closure for opening and closing the storage compartment to permit access to the spare components stored therein, and to closing the compartment during storage. The storage compartment is attached to the string of decorative lights so that the spare components stored therein are conveniently accessible when needed to replace a component in the light string.

35 Claims, 5 Drawing Sheets

DECORATIVE LIGHT STRING WITH STORAGE COMPARTMENT FOR REPLACEMENT COMPONENTS

CROSS-REFERENCE TO RELATED APPLICATION

This application is a division and continuation-in-part of pending application Ser. No. 09/854,255 filed May 14, 2001, and entitled "Light Plug With Storage Compartment."

BACKGROUND AND SUMMARY OF THE INVENTION

This invention relates to electrical plugs and receptacles and more particularly to a storage compartment formed with or attached to the plug or receptacle.

Many electrical devices are supplied with a multitude of replacement components. This is especially true of strings of Christmas Lights. These light strings are generally comprised of approximately one hundred lamps wired in series. The lamps vary in size, voltage and color. One manufacturer's lamps are not necessarily interchangeable with another manufacturer's lamps. Furthermore the lamp voltages, bases and sockets are not necessarily the same from manufacturer to manufacturer. Bulbs have different voltages, types of glass bottoms to prevent twisting and different plastic bases that may or may not fit and some will fit but are loose so arcing can be a problem. Some manufacturers furnish spare parts in a plastic bag packaged with a new light string, but the user has no way to keep the spare parts with the light string.

The fuses used to protect each string of lamps are also not necessarily interchangeable from string to string as the amperage of each string may vary from manufacturer to manufacturer. For example the one ampere fuse from a fifty light string and the three ampere fuse from a one hundred light string are not interchangeable.

Christmas Lights are commonly purchased a few strings at a time. At the time of original purchase, each string of Christmas Lights is normally supplied with spare lamps, flashers and spare fuses. These are selected to match the original string of lamps so that the user has the proper replacement parts. Having and using the proper replacement parts is not only a convenience, it is a matter of safety. It is common that the replacement parts are placed in a plastic bag that is packed with the string of lights. The bag may be left loose in the package or may be stapled or taped to the light string. Each manufacturer has its own set of spare fuses and lamps resulting in the user collecting numerous bags of spare parts. Generally the user takes the spare parts bag and puts it away. The bag is often lost, misplaced or otherwise can't be located when the parts are needed. If the user finds the place where the numerous bags of spare parts are kept, the user usually cannot identify which bag of spare parts is used for a given string of lights.

Some people merely throw the entire string of lights away if a bulb burns out. This is expensive, wasteful and is inconvenient to keep replacing an entire light string when one lamp bums out. Leaving the burned lamp in its socket increases the voltage to other lamps in the string resulting in shortening the life of the other lamps and exacerbates the problem. Equally important, the user may just go through his spares until he finds one that fits, which can lead to other problems, such as the wrong voltage or loose connections.

The manufacturer may also supply special tools or items such as a bulb remover designed for use with the Christmas Lights. The problem with this is the same as the replacement bulbs; the tool can be easily lost. Another problem is that these special bulb removing tools are always sold separately and have not been provided with the light set in the current marketplace.

Applicant's invention solves the problem of losing or misplacing the spare parts provided with a string of Christmas Lights. A storage compartment is provided as a part of the light string. It can be molded as a part of the plug or receptacle on an end of the light string, or it can be an add-on compartment for existing plugs, receptacles or light-string wires. The compartment can be opened from the top, side or surface end to allow access to the interior of the compartment. The compartment is designed to accommodate the extra lamps and fuses normally supplied in a plastic bag. The compartment can also provide access to an easy-to-store bulb remover, or the bulb remover can be formed as a part of the compartment.

Thus, it is a primary object of the present invention to provide a decorative light string with an integral or attached storage compartment for spare components such as spare lamps and fuses.

Another object is to provide a decorative light string having an electrical plug or receptacle with a storage compartment in which the storage compartment has integrally formed therein a lamp-removing tool. The advantage of this is that it eliminates the need for a separate tool that may be easily lost.

Another object is to provide a decorative light string having an integral or attached storage compartment that can be economically and efficiently manufactured.

Yet another object is to have readily available the proper replacement components for a decorative light string, to minimize the possibility of the user selecting and using the wrong replacement component, such as an improperly sized fuse which creates a safety hazard.

These and other objects and advantages will be apparent to those skilled in the art from the following description and the accompanying drawings.

DETAILED DESCRIPTION OF PREFERRED EMBODIMENTS

Figure 1:
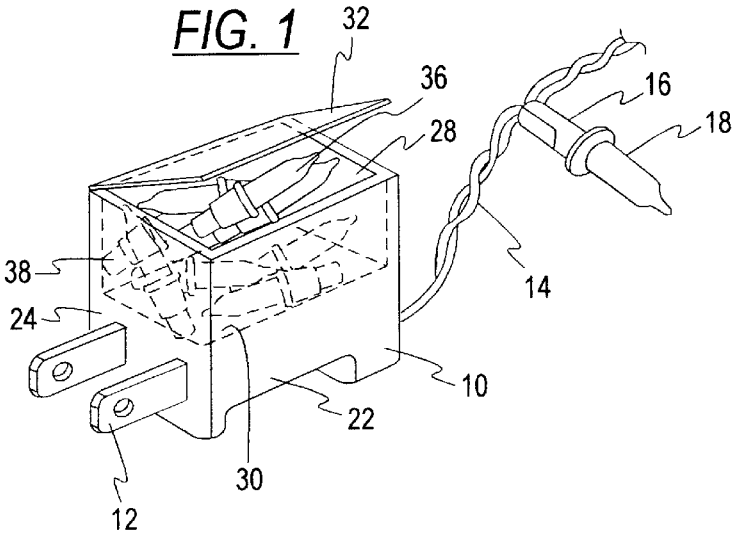
FIG. 1 is a perspective view of a decorative light string embodying the invention.

Turning to FIG. 1, there is illustrated an electrical plug 10 molded of an electrically non-conductive material such as plastic or a rubber compound. There are electrical prongs 12 that engage a socket. Alternatively the electrical plug can be formed as a receptacle 11 (FIG. 9) on the female end or socket end of an electrical cord. There are two or more, commonly three, electrical wires 14 that connect to the prongs 12 or, in the case of a female plug, to the receptacles in the socket. Throughout this application the term "electrical plug" shall also mean an "electrical socket". The electrical wires 14 have a plurality of electrical sockets 16 connected to them. In the case of Christmas Lights, the electrical connection is generally a series connection. Each socket 16 has a lamp 18 mounted in it. There may be thirty-five to one hundred fifty lights in a string of Christmas Lights. The lamps are commonly 2.5 or 3.5 volts each and may be made of various colors for decoration.

Figure 2:
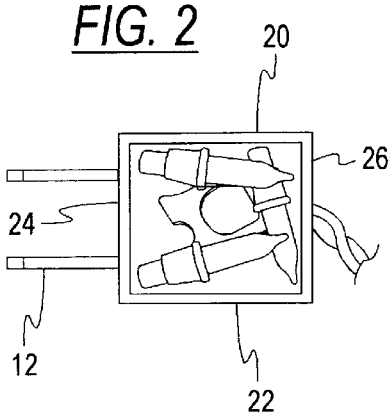
FIG. 2 is a top view of the electrical plug included in the light string of FIG. 1.
Figure 3:
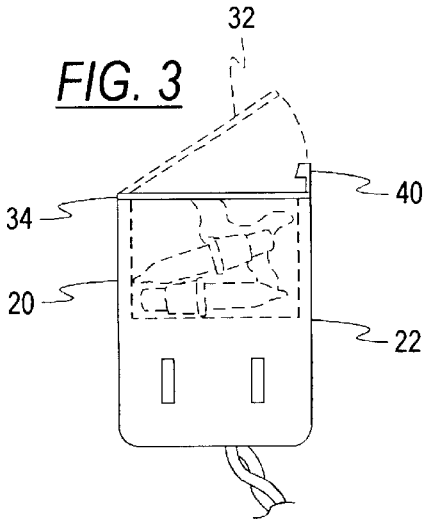
FIG. 3 as a left end view of the electrical plug of FIGS. 1 and 2.
Figure 4:
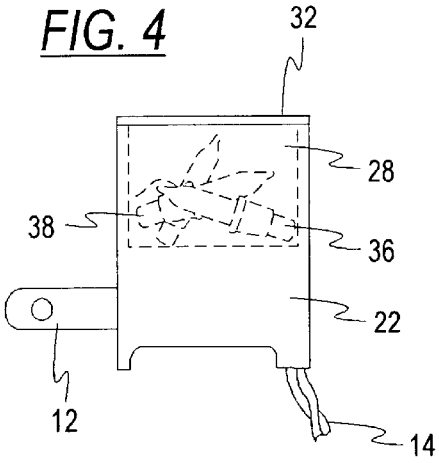
FIG. 4 is a side elevation view of the electrical plug of FIGS. 1 and 2.

As seen in FIGS. 1 and 2, the molded plug 10 has a pair of opposed sidewalls 20, 22, a front wall 24 and a rear wall 26. Alternatively the molded plug may be formed of other configurations such as a dome, cylinder or circle. Within the confines of the walls 20–26 is a compartment 28. The compartment 28 has a bottom 30. There is a cover 32 that closes the top of the compartment 28. The cover 32 is attached to the sidewall 20 by means of a molded or living hinge 34. The living hinge 34 can be formed at the same time that the electrical plug 10 is molded. This minimizes the cost and number of components necessary to attach the cover 32 to the sidewall 20. The cover 32 can be made of clear plastic or colored plastic or rubber, depending on the needs and desires of the manufacturer and user. The compartment is dimensioned to hold several spare lamps 36, spare fuses 38 and a bulb pulling tool.

The cover 32 can also be provided with a set of raised domes or bubbles that are used to indicate light bulb voltage, amperage or other information relating to the bulbs or fuses. By depressing the appropriate domes or bubbles, the user has a visual indication of the bulbs or fuses to buy for replacement items. Additional information such as the number of lights in a string, the length of the string, the date purchased or other such indications can also be added to the cover by similar indicia. Alternatively, the voltage, amperage or other important information can be molded into the plug 10, the cover 32 or bottom 30 when the parts are formed. This is a safety feature so that the user always knows what size lamps and fuses he or she should be using with a string of lights.

In order to keep the cover 32 in a secure closed position on the compartment 28, there is provided a latch means 40 on the top of the side wall 22. The latch can be a molded piece of rubber that engages an edge of the cover 32 opposite the living hinge. Instead of a latch, a magnetic strip may be added to the top of the sidewall 22 and a complementary magnetic strip on the edge of the cover 32. Other closure devices could be utilized as known in the art. If desired, the cover may be made water-tight to keep moisture from entering the compartment 28 and possibly damaging the spare lamps 36 or fuses 38.

As described above, there is provided a compartment 28 that is capable of storing spare lamps 36 and spare fuses 38 that is integral with the molded electrical plug 10. The spare components are readily accessible when needed. The user merely opens the cover 28, removes the needed spare, and closes the cover. There is no searching for the whereabouts of the spare parts bag or worrying about installing a wrong lamp or fuse. The current system of supplying the spare parts in a bag that is stapled to the wires between two of the bulbs also presents another safety issue. The staple can pierce the insulation and wire or can scratch the wire or the person removing the staple.

Figure 5:
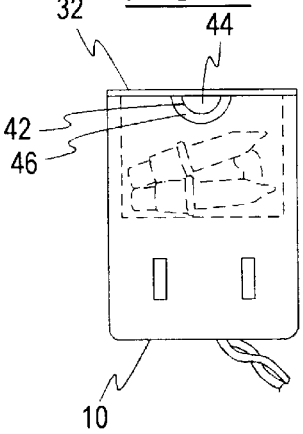
FIG. 5 is a left end view of a first alternative embodiment of an electrical plug in which a semi-circular lamp remover is formed in the body of the plug.

In FIG. 5, there is an alternative embodiment in which a semi-circular recess 42 is formed in the front wall 24. The semi-circular recess 42 forms an opening 44 that creates a lamp remover tool to remove burned out lamps from their respective sockets. The diameter of the opening 44 is substantially the same as the diameter of the base of the lamp 18. This allows the base of a burned out lamp 18 to be inserted into the opening 44 when the cover is opened. The cover is closed and held down by the user. This securely holds the lamp in the opening 44. The user then pulls the socket 16 away from the lamp 18. Optionally the recess 42 may have a metal insert 46 placed around its edge if the material forming the front wall 24 is not strong enough to withstand the force necessary to remove the burned out lamp. The recess is illustrated in the front wall 24 but can also be formed in the rear wall 26. A small piece of flexible material can also be formed on the cover or as part of the front wall 24 to partially or completely cover the opening 44. This keeps the spare lamps or fuses from falling out through the opening 44.

Figure 6:
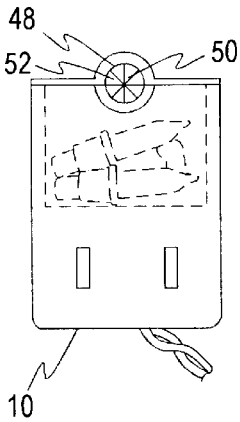
FIG. 6 is a left end view of a second alternative embodiment of an electrical plug in which the body of the plug and the cover form a circular lamp remover.

FIG. 6 illustrates another alternative embodiment. The cover 28 is formed with a semi-circular dome 48 that aligns with the semi-circular recess 42 in the front wall 24. The aligned dome 48 and recess 42 form a circular opening 50. The dimension should be slightly smaller than the diameter of the socket 16. When a burned out lamp 18 is inserted into the opening 50, the user holds the socket 16 in place. The lamp 18 is then pulled out from the socket 16. There is optionally provided a flexible webbed material 52 that has a plurality slits emanating from the center of the opening 50 toward the circumference of the opening 50. This provides a covered opening that is easily penetrated by a lamp 18 when it is inserted into the opening 50. The webbed material 52 can be easily formed with the cover 32 and front wall 24.

Figure 7:
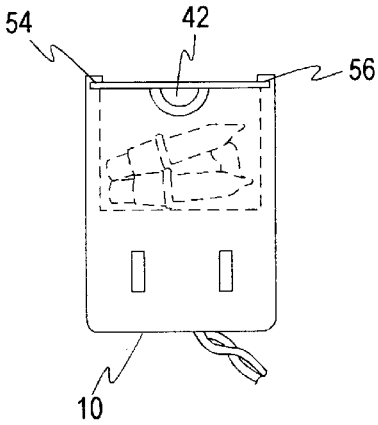
FIG. 7 is a left end view of a third alternative embodiment of an electrical plug in which the cover is slidably retained in channels on the body of the plug.

FIG. 7 illustrates another alternative embodiment in which the cover 32 is attached to the molded plug 10 by a different means. Instead of using a molded hinge 34, the cover 32 is held within a pair of U-shaped channels 54, 56 extending along the top of the sidewalls 20, 22. The U-shaped channels 54, 56 retain the edges of the cover 32 so that the cover can be removed from the compartment 28 by sliding the cover 32 horizontally along the top of the compartment 28. The same types of lamp removers as described in the alternative embodiments shown in FIGS. 5 and 6 can be used with the embodiment shown in FIG. 7.

Figure 8:
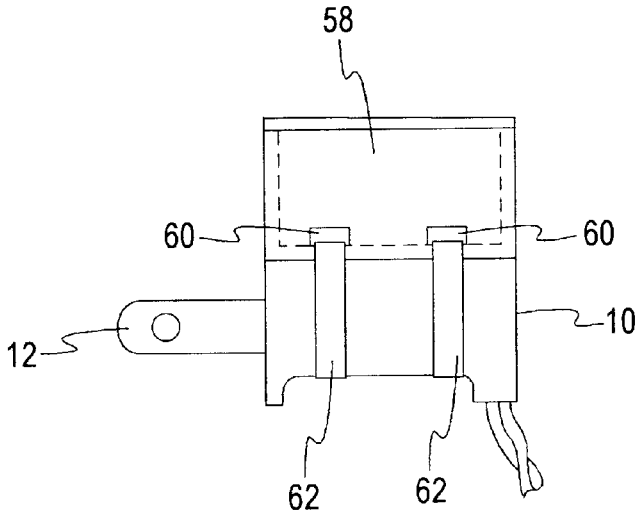
FIG. 8 is a side elevation view of a fourth alternative embodiment of an electrical plug in which the compartment is a separate component that is attached to a conventional electrical plug.

FIG. 8 illustrates another alternative embodiment in which a compartment 58 is formed as a separate stand-alone element. The compartment 58 can have the same features as the previously described compartment 28 such as different closure means and alternative lamp removal devices. However the compartment 58 has one or more open slots 60 at its bottom. The slots 60 receive plastic closure devices 62 such as conventionally used to secure bundles of wires together. These wire ties 62 securely hold the compartment 58 to the molded electrical plug 10. Other means such as clips or clamps can be used to attach the compartment 58 to the plug 10. Such alternative fastening means will be apparent to those skilled in the art. In this manner the compartments 58 can be added to existing Christmas Light strings.

Figure 9:
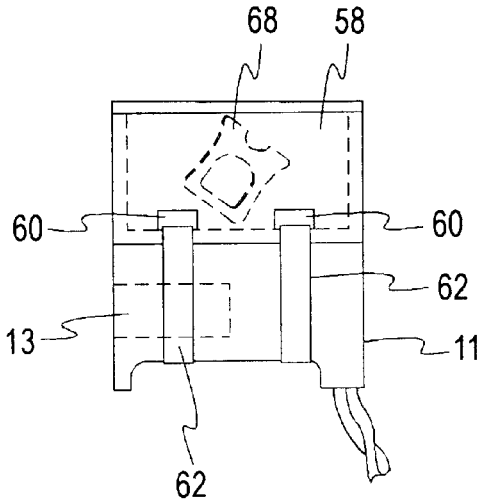
FIG. 9 is a side elevation view of another alternative embodiment in which the compartment is attached to a receptacle instead of a plug.

FIG. 9 illustrates another alternative embodiment in which the plug 10 is replaced by a receptacle 11 having electrically conductive socket receiving slots 13 to receive the electrical prongs 12. The compartment 58 is otherwise the same as described in FIG. 8 above. The compartment 58 is shown holding a bulb puller or bulb removing tool 68. Any of the plugs 10 described herein can be replaced by a receptacle 11 with all other features of the compartment remaining intact.

Figure 10:
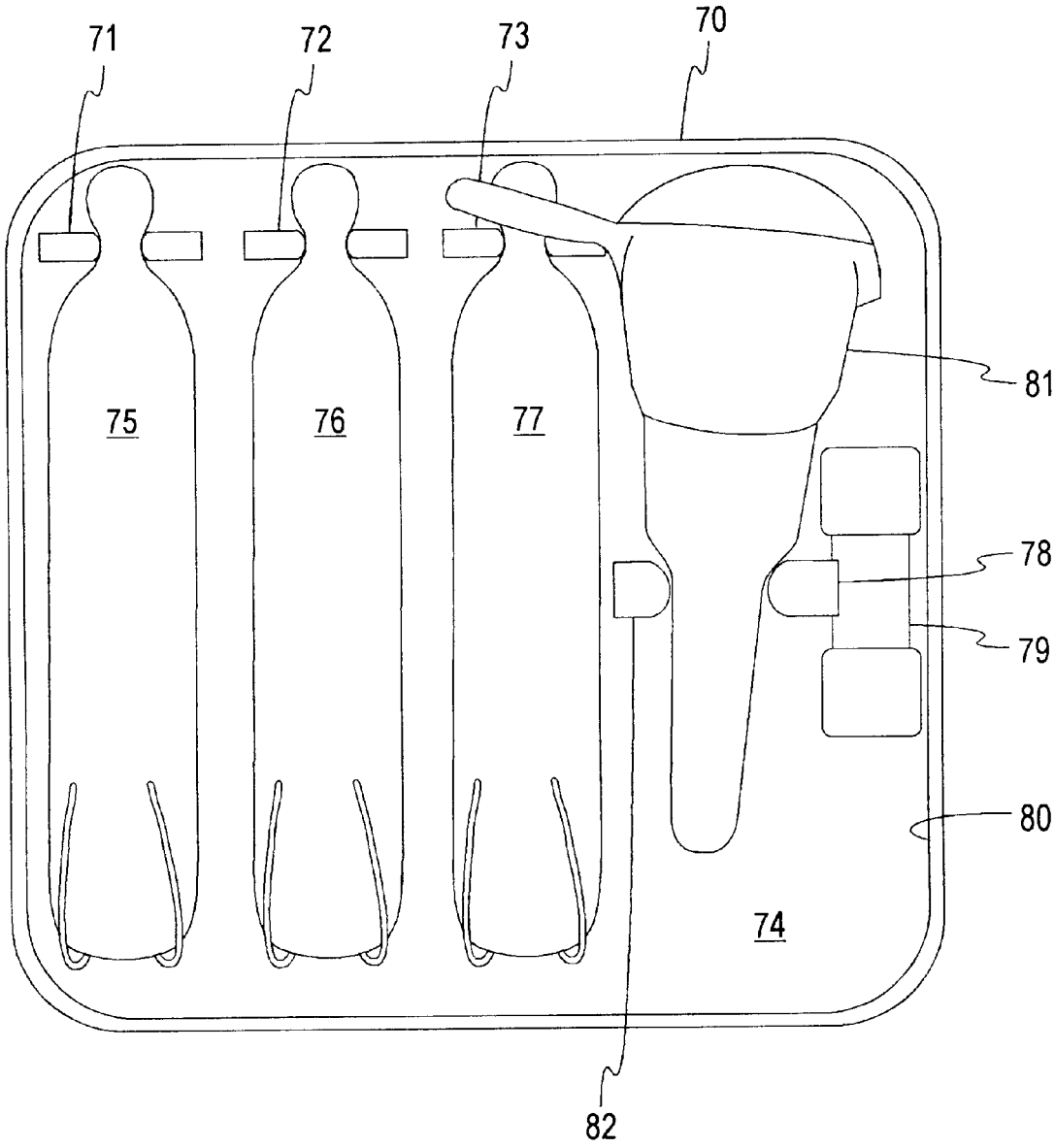
FIG. 10 is a plan view of another alternative embodiment of a storage compartment that can be attached to a plug, receptacle or wires of a light string.

FIG. 10 illustrates a modified storage compartment 70 that provides sub-compartments for more organized storage of different types of replacement components. The entire storage compartment shown in FIG. 10 is preferably formed as a single molded plastic part. Three yokes 71, 72 and 73 extend upwardly from the bottom wall 74 of the compartment 70 to receive the tips of three replacement lamps 75, 76 and 77, respectively. The open upper end of each of the yokes 71–73 forms an opening that is slightly smaller than the minimum cross-sectional dimension of the lamp, and then flares out in the central portion of the yoke to approximately match the minimum cross-sectional dimension of the lamp. As a lamp is pressed down into the open end of the yoke, the two arms of the yoke are forced slightly apart to allow the lamp to enter, and then the arms spring back to capture the lamp within the yoke as the lamp enters the wider central portion of the opening in the yoke.

Near the right-hand side of the compartment as viewed in FIG. 10, a post 78 extends upwardly from the bottom wall 74 to capture a replacement fuse 79 against the adjacent sidewall 80 of the compartment 70. The side of the post 78 facing the sidewall 80 is undercut slightly beneath its free end to capture the fuse 79 after it has been pressed down into the space between the post 78 and the sidewall 80, deflecting the resilient post 78 slightly away from the sidewall 80 in the process.

The space between the post 78 and the end yoke 73 is utilized to store a lamp base 81 inserted between the post 78 and a second post 82 extending upward from the bottom wall 74. The second post 82 positions the lamp base 81 between the fuse 78 and the lamp 77.

The storage compartment of FIG. 10 can be provided with any of the different types of closures described above, such as a lid attached to one sidewall of the compartment by a living hinge. Alternatively, a plug or receptacle attached to an end of the light string may be provided with depending L-shaped flanges that mesh with corresponding exterior grooves in a pair of opposed sidewalls of the compartment so that the plug or receptacle serves as a closure for the storage compartment. A simple latch may be provided to prevent the compartment from sliding off the flanges.

Figure 11:
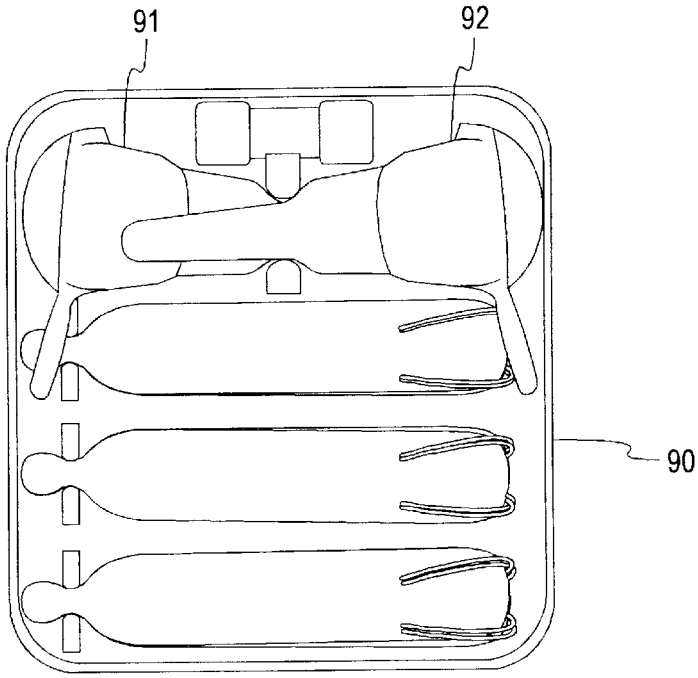
FIG. 11 is a plan view of a modified version of the embodiment of FIG. 10 in which the storage compartment accommodates two tiers of replacement components.
Figure 12:
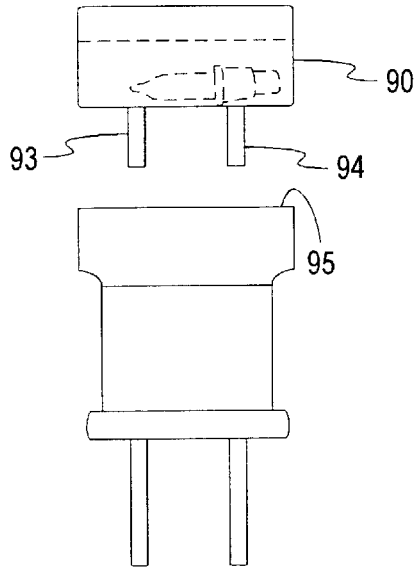
FIG. 12 is a side elevation of the storage compartment of FIG. 11 and a light-string plug to which the storage compartment is attachable.
Figure 13:
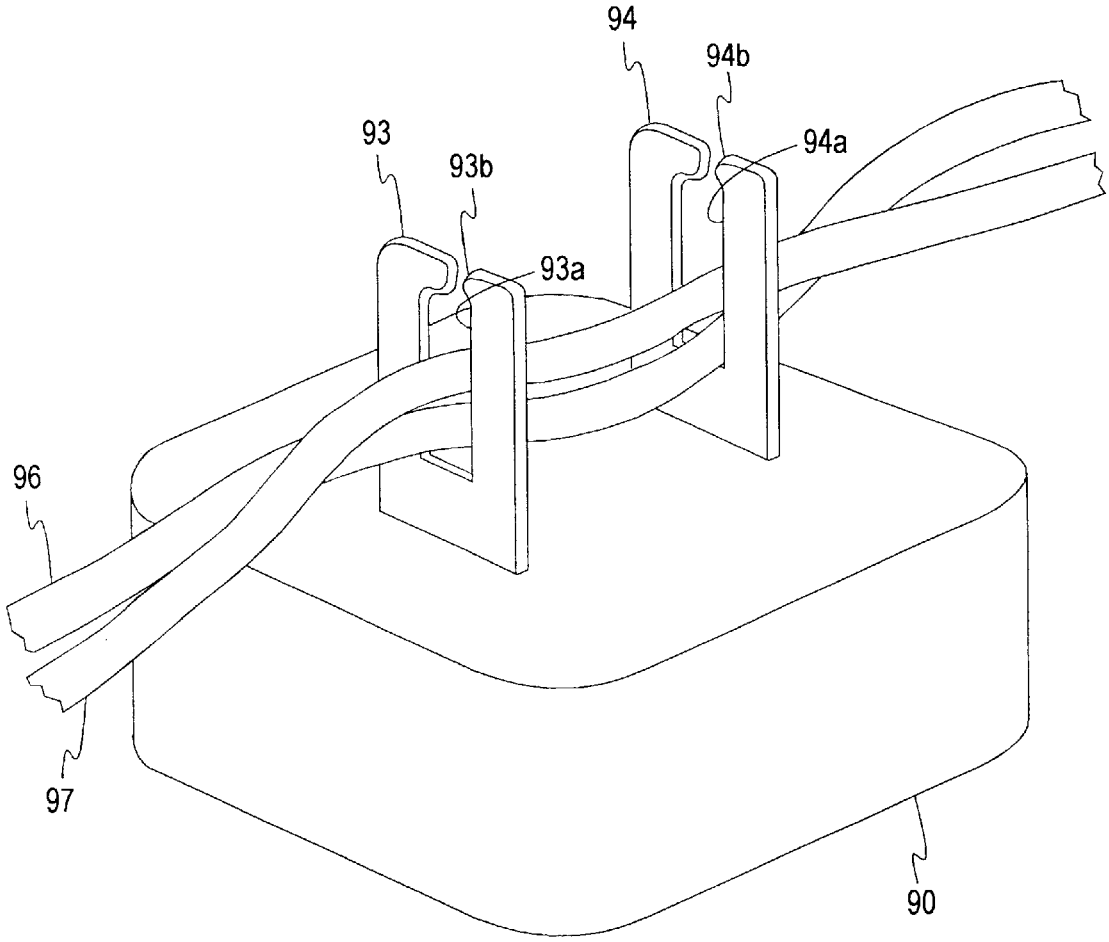
FIG. 13 is a bottom perspective view of the storage compartment shown in FIG. 12.

FIGS. 11–13 illustrate a modified storage compartment 90 that is dimensioned to receive two tiers of replacement components. The thickest components are the lamp bases 91 and 92, which are much smaller at their lower ends than at their upper ends. Thus, as can be seen in FIGS. 11 and 12, they are stored with their small ends overlapping, so that the depth of the storage compartment need be increased by only about 50% to receive the two overlapping bases 91 and 92. This increase in depth is sufficient to accommodate two tiers of lamps and fuses.

As can be seen in FIGS. 12 and 13, the storage compartment 90 is provided with two plastic prongs 93 and 94 formed as an integral part of the storage compartment and adapted to fit into the socket of a standard socket 95 on the end of a light string. Thus, the storage compartment 90 can be removably attached to a light string by simply plugging it into the socket typically provided on one end of a light string. In addition, as can be seen in FIG. 13, the plastic prongs 93 and 94 form notches 93*a* and 94*a* so that the prongs can be removably attached to the wires 96 and 97 of a light string. Each of the notches 93*a* and 94*a* has a narrow throat 93*b* or 94*b* at its open end to hold the storage compartment 90 captive on the wires 96, 97 after the prongs 93, 94 have been pressed onto the wires.

Thus there has been described a that has a storage compartment for safely and securely storing spare components such as lamps and fuses. Furthermore the storage compartment may include an integrally formed lamp remover. Although the invention has been described in conjunction with certain specific embodiments, it will be understood that alternatives, modifications and variations will be apparent to those skilled in the art in light of the foregoing description. Accordingly it is intended to embrace all such alternatives, modifications and variations as fall within the spirit and scope of the appended claims.

What is claimed is:

1. A string of decorative lights comprising:

a plurality of elongated electrical conductors having multiple electrical lamps connected thereto at intervals along the lengths of the conductors, a small storage compartment for storing spare components for use in said string of decorative lights, a movable closure for opening said storage compartment to permit access to the spare components stored therein, and for closing the compartment during storage of the spare components, and means for attaching said storage compartment to said string of decorative lights so that the spare components stored therein are conveniently accessible when needed to replace a component in said light string.

2. The decorative light string of claim 1 which includes a plug or receptacle on at least one end of said string, and said storage compartment is attached to said light string by being formed as a part of said plug or receptacle.

3. The decorative light string of claim 1 which includes a receptacle on at least one end of said string, and said storage compartment is attached to said light string by prongs projecting from an exterior surface of said storage compartment and positioned and dimensioned to fit into said receptacle.

4. The decorative light string of claim 1 wherein said storage compartment is divided into sub-compartments for segregated storage of different components.

5. The decorative light string of claim 1 wherein said movable closure includes a cover and a hinge connecting said cover to said storage compartment to allow the cover to pivot about the hinge to selectively open and close the compartment.

6. The decorative light string of claim 1 further comprising latching means for selectively maintaining said movable closure in a closed position.

7. The decorative light string of claim 1 wherein said storage compartment includes at least two opposite interconnected walls forming channels adapted to slidably receive said movable closure for opening and closing said compartment.

8. The decorative light string of claim 1 wherein said storage compartment includes a wall forming a first opening adapted to receive in frictional engagement a base of an electrical lamp, to assist in removing the electrical lamp from a socket.

9. The decorative light string of claim 8 wherein said movable closure includes a domed portion defining a second opening aligned with said first opening to receive the base of the electrical lamp in frictional engagement to assist in removing the electrical lamp from a socket.

10. The decorative light string of claim 8 further comprising means to cover said openings when no bulb is placed therein for removal.

11. The decorative light string of claim 1 wherein said compartment includes means for selectively indicating a technical specification of said spare components.

12. A method of storing spare components for use in a string of decorative lights, said method comprising:

placing said spare components in a small storage compartment having a movable closure for opening the compartment to permit access to the spare components stored therein, and for closing the compartment during storage of the spare components, and attaching said storage compartment to said string of decorative lights so that the spare components stored therein are conveniently accessible when needed to replace a component in said light string.

13. The method of claim 12 wherein said light string includes a plug or receptacle on at least one end of the string, and said storage compartment is attached to said light string by being formed as a part of said plug or receptacle.

14. The method of claim 12 wherein said light string includes a receptacle on at least one end of the string, and said storage compartment is attached to said light string by prongs projecting from an exterior surface of said storage compartment and positioned and dimensioned to fit into said receptacle.

15. The method of claim 12 wherein said storage compartment is divided into sub-compartments for segregated storage of different components, and said different components are placed in different ones of said sub-compartments.

16. The method of claim 12 which includes selectively indicating a technical specification of said spare lamps on a surface of said storage compartment.

17. A string of decorative lights comprising:

a plurality of elongated electrical conductors having multiple electrical lamps connected thereto at intervals along the lengths of the conductors, a receptacle attached to one end of said conductors, a small storage compartment for storing spare components for use in said string of decorative lights, a plurality of prongs projecting from an exterior surface of said storage compartment and positioned and dimensioned to fit into said receptacle, and a movable closure for opening said storage compartment to permit access to the spare components stored therein, and for closing the compartment during storage of the spare components.

18. The decorative light string of claim 17 wherein said storage compartment is a molded plastic part.

19. The decorative light string of claim 18 wherein said prongs are formed as an integral portion of said molded plastic part.

20. The decorative light string of claim 17 wherein said prongs are notched for fitting over the conductors of said light string, so that said storage compartment can be removably attached to said conductors.

21. The decorative light string of claim 17 wherein said storage compartment is divided into sub-compartments for segregated storage of different components.

22. The decorative light string of claim 17 wherein said compartment includes means for selectively indicating a technical specification of said spare components.

23. A decorative light string comprising:

a molded electrical power connector;

at least first and second electrical conductors retained in the molded electrical power connector;

at least first and second electrical wires, said first wire being connected to said first electrical conductor and said second wire being connected to said second electrical conductor;

multiple decorative electrical lamps connected to said electrical wires at spaced intervals along the lengths of said wires;

a storage compartment integrally formed with the molded electrical power connector for storing spare lamps and other components of said light string, and a movable closure for opening the compartment to permit access to the spare components stored therein, and for closing the compartment during storage of the spare components.

24. The decorative light string of claim 23 and further comprising hinge means for connecting said movable closure to the compartment for allowing the closure to pivot about the hinge means to selectively open and close the compartment.

25. The decorative light string of claim 24 and further comprising locking means for selectively maintaining the closure in a closed position until the closure is to be opened.

26. The decorative light string of claim 23 and further comprising opposite channels on the compartment, the channels adapted to slidably receive the closure, whereby the closure can be selectively slid in the channels to open and close the compartment.

27. The decorative light string of claim 23 and further comprising an opening in the compartment, the opening adapted to receive in frictional engagement a base of an electrical lamp, to assist in removing the electrical lamp from a socket.

28. The decorative light string of claim 27 and further comprising a domed portion on the closure, the domed portion defining a second opening, the second opening aligned with the opening to receive the base of the electrical lamp in frictional engagement to assist in removing the electrical lamp from a socket.

29. The decorative light string of claim 27 and further comprising means to cover the opening when no lamp is placed therein for removal.

30. The decorative light string of claim 23 wherein the compartment is defined by at least four walls, a front wall, a rear wall opposite the front wall, and opposite sidewalls.

31. The decorative light string of claim 23 wherein said compartment has means for selectively indicating a technical specification of said spare lamps.

32. A decorative light string comprising:

an electrical power connector;

at least first and second electrical conductors retained in the electrical power connector;

at least first and second electrical wires, said first wire being connected to one of the electrical conductors and said second wire being connected to the other electrical conductor;

multiple decorative electrical lamps connected to said electrical wires at spaced intervals along the lengths of said wires;

a storage compartment integrally formed with the electrical power connector for storing spare lamps and other components of said light string, and a movable closure for opening the compartment to permit access to the spare components stored therein, and for closing the compartment during storage of the spare components.

33. The decorative light string of claim 32 and further comprising an opening in said compartment for receiving a base of an electrical lamp for removing the lamp from an electric socket.

34. A method of storing spare components for use in a string of decorative lights having an electrical power connector on one end thereof, said method comprising:

placing said spare components in a storage compartment integrally formed with said electrical power connector and having a movable closure for opening the compartment to permit access to the spare components stored therein, and for closing the compartment during storage of the spare components, and opening said storage compartment and retrieving one or more selected spare components from said compartment when a component fails in said string of decorative lights, and re-closing said compartment.

35. The method of claim 34 which includes selectively indicating a technical specification of said spare lamps on a surface of said storage compartment.

* * * * *